United States Patent [19]

Wood

[11] 4,413,729

[45] Nov. 8, 1983

[54] ARTICLE CARRIER

[75] Inventor: Prentice J. Wood, Hapeville, Ga.

[73] Assignee: The Mead Corporation, Dayton, Ohio

[21] Appl. No.: 360,744

[22] Filed: Mar. 22, 1982

Related U.S. Application Data

[63] Continuation of Ser. No. 127,988, Mar. 7, 1980, abandoned.

[51] Int. Cl.[3] ..... B65D 75/00

[52] U.S. Cl. ..... 206/188; 229/28 BC; 229/52 BC

[58] Field of Search ..... 206/172, 180, 181, 188, 206/185, 184, 186, 193, 187, 175; 229/28 BC, 52 BC

[56] References Cited

U.S. PATENT DOCUMENTS

| | | | |
|---|---|---|---|
| 3,104,027 | 9/1963 | Kulig | 206/184 |
| 3,400,856 | 9/1968 | Arneson | 206/188 |
| 4,187,944 | 2/1980 | Wood | 206/187 |
| 4,253,564 | 3/1981 | Engdahl, Jr. | 206/183 |
| 4,258,844 | 3/1981 | Stout | 206/188 |

*Primary Examiner*—Joseph Man-Fu Moy
*Attorney, Agent, or Firm*—Erwin Doerr

[57] ABSTRACT

A cellular article carrier of the basket type formed from a single blank and comprising a series of cells provided on opposite sides of a longitudinal medial partition, the cells of each series being separated from an adjacent cell by a transverse partition structure including a main transverse partition panel hinged to the longitudinal medial partition and a supplementary transverse partition panel hinged in overlapping relationship to the main transverse partition panel, the overlapped faces of all the supplementary partition panels being presented towards one and the same end of the carrier.

4 Claims, 6 Drawing Figures

ARTICLE CARRIER

This application is a continuation of application Ser. No. 127,988, filed Mar. 7, 1980.

This invention relates to a cellular article carrier of the type which is fabricated from a single blank of flexible sheet material, the blank being cut and creased so that it is divided into a number of panels which thereafter are folded and secured in a predetermined relationship with respect to one another so as to provide an article carrier having a multiplicity of article accommodating cells.

Cellular bottle carriers have been designed for use in connection with the marketing or bottled beverages and have been fabricated from relatively lightweight stock such that the individual cells are separated by the thickness of material required in order to meet railroad shipping regulations. In order to achieve this, some such carriers include the provision of a two-ply thickness of material between individual cells. However, in some constructions in order to meet this provision a complicated folding technique is involved in fabricating the carrier from the stock. The present invention achieves the required result with relatively few folding operations while at the same time achieving an economical use of material.

The invention provides a cellular article carrier comprising a bottom wall, spaced side walls hinged to opposite edges of the bottom wall, end wall panels hinged to the end edges of said side walls and extending inwardly therefrom, a medial partition structure at one end of the carrier comprising a pair of medial panels foldably joined respectively to said end wall panels at said one end of the carrier along the edges thereof remote from said side walls and extending medially inward of the carrier, medial partition structure at the other end of the carrier comprising a pair of medial panels foldably joined respectively to said end wall panels at said other end of the carrier along edges thereof remote from said side walls and extending medially inward of the carrier, each of said medial partition panels having struck therefrom a transverse partition structure comprising a main transverse partition panel hinged to that medial partition panel, a supplementary transverse partition panel hinged to said main transverse partition panel and an anchoring tab hinged to said supplementary transverse partition panel, said anchoring tab being secured to the adjacent side wall of the carrier to hingedly connect the transverse partition structure to said side wall and wherein one face of said supplementary transverse partition panel has a portion folded into face to face relationship with a free margin portion of said main transverse partition structure the folding being such that the overlapped faces of all the supplementary partition panels are presented towards one and the same end of the carrier.

For a better understanding of the invention reference is now made to the following detailed description and the accompanying drawings in which.

Figure 1:
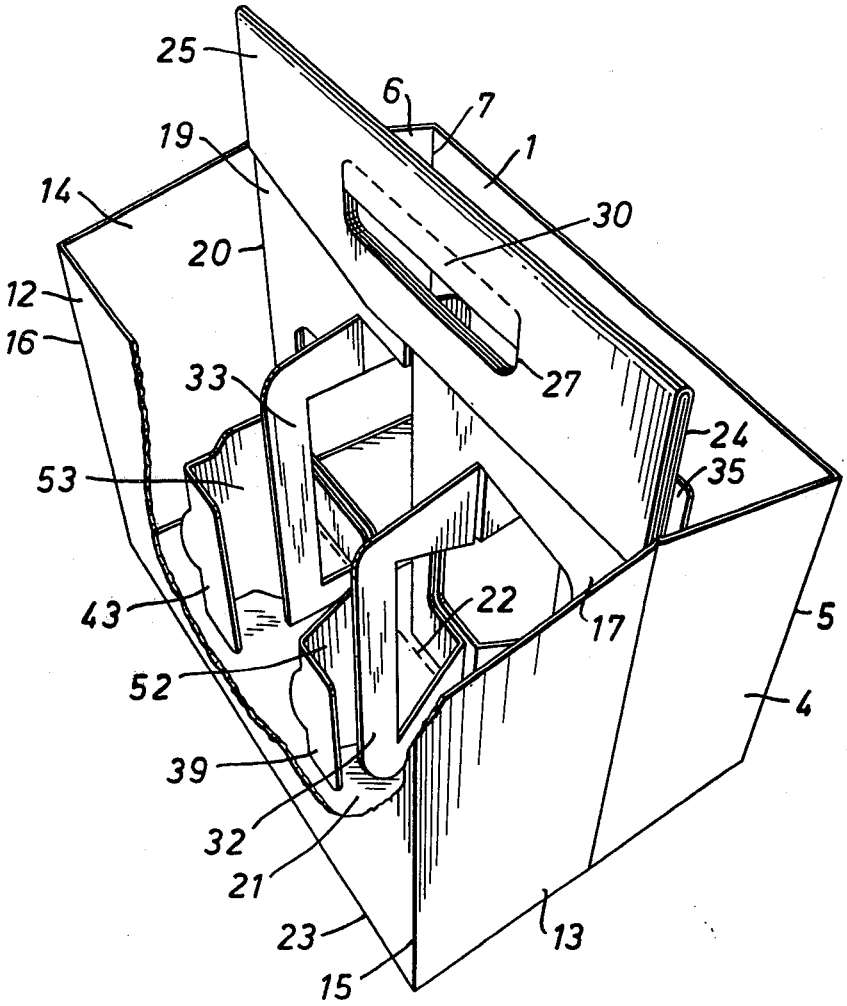
FIG. 1 is a perspective view of an article carrier shown in set up empty condition and with a portion thereof broken away.

Referring to the drawings the numeral 1 designates a side wall of the article carrier to the bottom edge of which a glue flap 2 is hinged along a fold line 3. An end wall panel 4 is hinged to one edge of the side wall 1 along a fold line 5 and a similar end wall panel 6 is hinged to the opposite edge of the side wall panel 1 along a fold line 7. Medial panels 8 and 9 are hinged to the end wall panels 4 and 6 respectively along fold lines 10 and 11. The medial panel 8 is provided with a projecting locking tab 8*a*.

The lower portion of the blank is similar to that just described and includes a side wall 12 to opposite side edges of which end wall panels 13 and 14 are hinged respectively along fold lines 15 and 16. A medial panel 17 is hinged to the end wall panel 13 along a fold line 18 and a medial panel 19 is hinged to the end wall panel 13 along a fold line 20. A bottom panel 21 is hinged to the bottom edge of the side wall panel 12 along a fold line 22 and the bottom panel 21 is divided into two parts by a medial fold line 23. The medial panel 17 includes a projecting locking tab 17*a* and the bottom panel 21 is formed with a generally triangular locking notch 21*a*.

A handle structure for the article carrier comprises handle panels 24 and 25 which are hinged respectively to the medial panels 9 and 19. The handle panels 24 and 25 are mirror images of each other about a central fold line 28. Hand gripping apertures 26 and 27 are respectively formed in handle panels 24 and 25 and are provided with cushioning flaps 29 and 30.

In order to provide for the individual article cells of the carrier, a transverse partition structure is provided and includes main transverse partition panels 31, 32, 33 and 34.

To ensure adequate separation between articles accommodated in adjacent cells supplementary transverse partition panels are provided. These are designated numerals 51, 52, 53 and 54. The transverse partition panel 31 is hinged respectively to supplementary transverse partition panel 51 along a fold line 55 and to medial panel 8 along fold lines 56 and 57. The transverse partition panel 32 is hinged to the supplementary transverse partition panel 52 along a fold line 58 and to the medial panel 17 along fold lines 59 and 60. At the opposite end of the blank the transverse partition panel 33 is hinged to the supplementary transverse partition panel 53 along a fold line 61 and to the medial panel 19 along fold lines 62 and 63. The transverse partition panel 34 is hinged to the supplementary transverse partition panel 54 along a fold line 64 and is further hinged to the medial panel 9 along fold lines 65 and 66. As can be seen each supplementary transverse partition panel is struck partly from its associated main transverse partition panel and partly from the adjacent medial panel.

Anchoring tab 35 is hinged to the supplementary transverse partition panel 51 along fold lines 36 and 37 which are joined together by a semi-circular line of cut 38. Similarly, an anchoring tab 39 is hinged to the supplementary transverse partition panel 52 along fold lines 40 and 41 which are separated by a semi-circular line of cut 42. At the opposite end of the blank an anchoring tab 43 is hinged to the supplementary transverse partition panel 53 along fold lines 44 and 45 which are connected together by a semi-circular line of cut 46. Similarly, an anchoring tab 47 is foldably joined to the supplementary transverse partition panel 54 along fold lines 48 and 49 which are connected together by a semi-circular line of cut 50. Each of the anchoring tabs are struck from the adjacent medial panels as best seen in FIG. 2 of the drawings.

Figure 2:
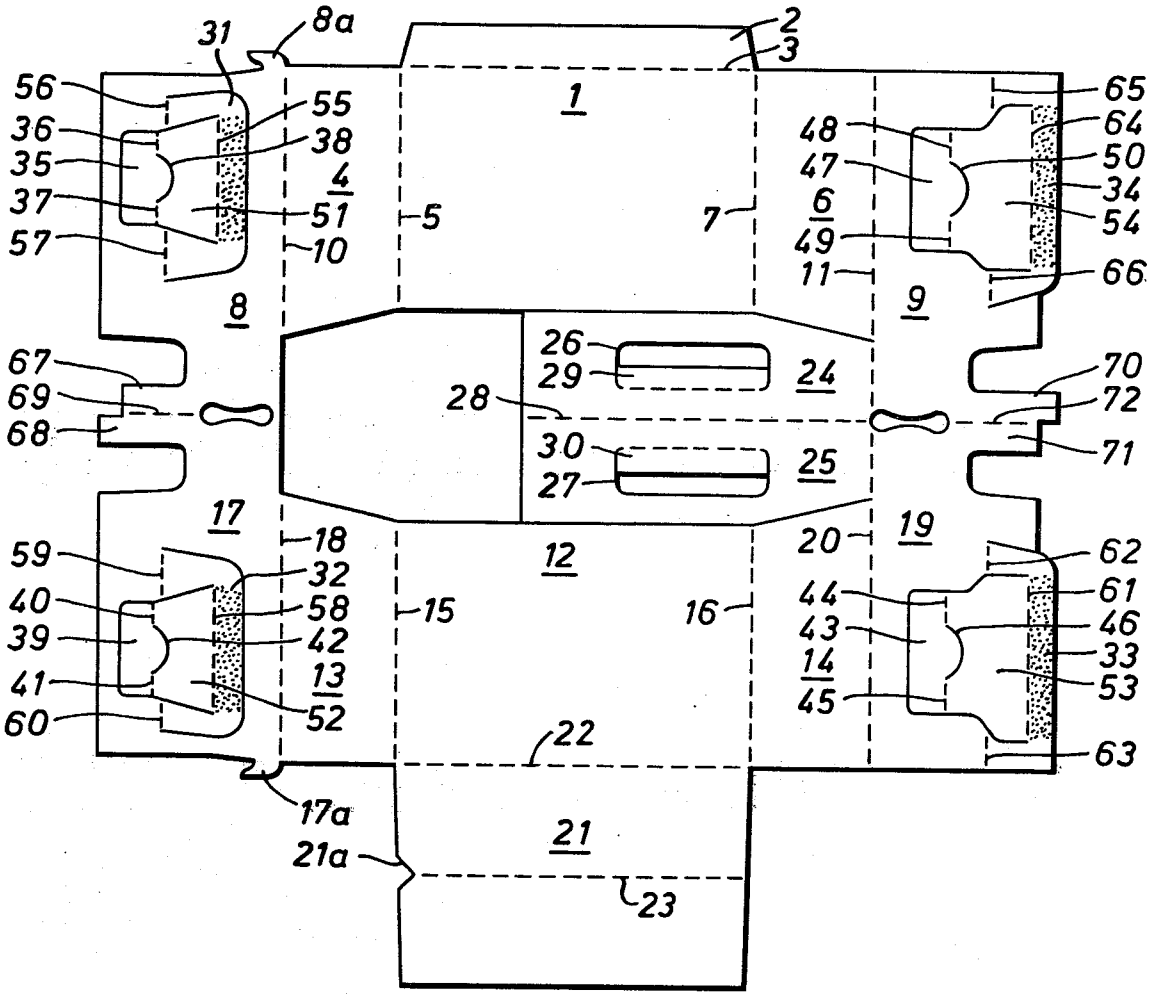
FIG. 2 is a plan view of a blank from which the article carrier shown in FIG. 1 is formed.

In order to provide additional strength in the area of the handle, a stepped tab projects into a scalloped area struck from the left hand end of the blank as viewed in FIG. 2. The projecting tab is formed from a finger 67 integral with the medial panel 8 and a somewhat longer finger 68 integral with the medial panel 17. Fingers 67 and 68 are hinged together joined along a fold line 69. Similarly, at the right hand edge of the blank as viewed in FIG. 2 a stepped tab projects into a scalloped area struck from the blank. The stepped tab comprises a finger 70 integral with the medial panel 9 and a finger 71 integral with the medial panel 19. The fingers are hinged together along a fold line 72. When the blank is manipulated to form the completed carrier the fingers 67, 68, 70 and 71 inter-digitate centrally of the handle structure.

In order to form the completed carrier from the blank shown in FIG. 2 an application of glue is first made to each of the main transverse partition panels 31, 32, 33 and 34 along a marginal part adjacent the free edge of the panel as shown in stippling alongside the fold lines 55, 58, 61 and 64 respectively. Thereafter, each of the supplementary transverse partition panels 51, 52, 53 and 54 together with their respective anchoring tabs are caused to be moved out of the plane of the blank, hinged about their respective fold lines 55, 58, 61 and 64 and rotated towards the right 180°, as viewed in FIG. 2, so as to occupy the positions shown in FIG. 3. The overlapping faces of the transverse partition panels 31 and 51 adjacent the fold line 55 are then adhered and similarly the overlapping faces of the transverse partition panels 32 and 52 adjacent the fold line 58 are adhered together. Likewise the overlapping faces of transverse partition panels 33 and 53 adjacent the fold line 61 are adhered together as are the overlapping faces of transverse partition panels 34 and 54 adjacent the fold line 64. At this stage, the first folding operation is completed.

Figure 3:
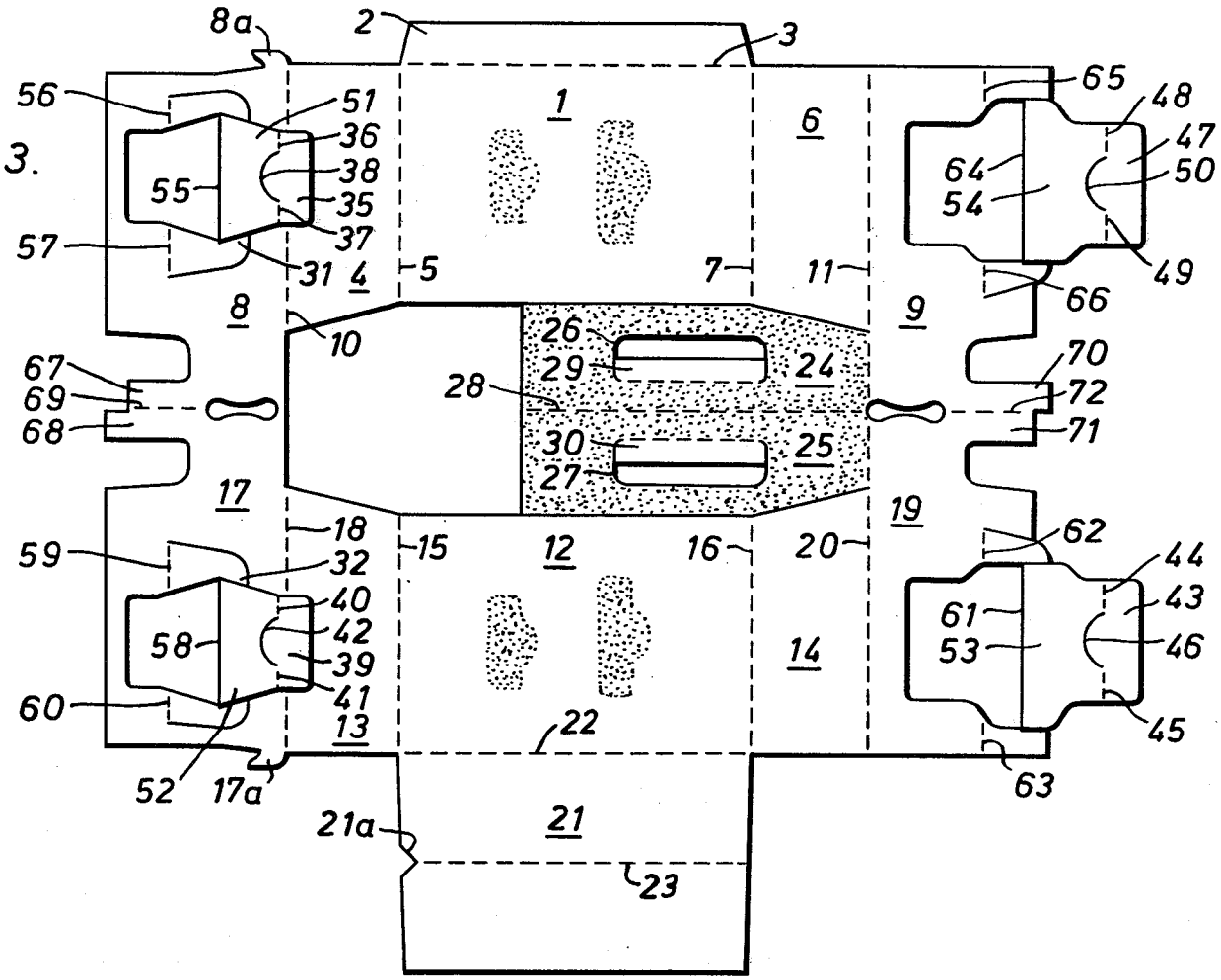
FIGS. 3, 4, and 5 depict intermediate stages through which the blank of FIG. 2 is manipulated in order to form a complete and collapsed article carrier as shown in FIG. 6 of the drawings.

As it is apparent from FIGS. 2 and 3, the overlapping face contacting portions of each and every one of the main transverse partition panels 31, 32, 33 and 34 of each and every one of the supplementary transverse partition panels 51, 52, 53 and 54 are areas which are initially present on one and the same face of the blank.

Furthermore, as will be understood from an inspection of the blank arrangement illustrated in FIGS. 2 and 3, transverse partition panels 31 and 32, supplementary transverse partition panels 51 and 52 and anchoring tabs 35 and 39 associated therewith are arranged entirely within the boundaries of the medial panels 8 and 17, respectively. It is to be noted, also, that anchoring tabs 35 and 39 extend in the same direction, e.g. to the left as illustrated, as do anchoring tabs 47 and 43 at the other end of the blank. As a result, all supplementary transverse partition panels will be rotated 180° and folded in one and the same direction when the carton is formed.

An application of glue is then applied to specific areas of the side walls 1 and 12 and simultaneously to the handle panels 24, 25. The glued areas are shown by stippling in FIG. 3 of the drawings. If convenient, the application of glue to the side walls 1 and 2 and to handle panels 24, 25 can be made simultaneously with the initial gluing operation.

The second folding operation causes the medial panels 9 and 19 to be moved together upwardly out of the plane of the blank as viewed in FIG. 3 so that the panels 9 and 19 are folded 180° towards the left about the fold lines 11 and 20 thereby bringing the anchoring tabs 43 and 47 into contact with one set of glued areas of the side wall panels 1 and 12 respectively. In this configuration which is shown in FIG. 4 of the drawings central areas of the medial panels 9 and 19 come into contact with the handle panels 24 and 25 and in particular the fingers 70, 71 of the stepped projection are adhered to the handle panels 24 & 25.

Figure 4:
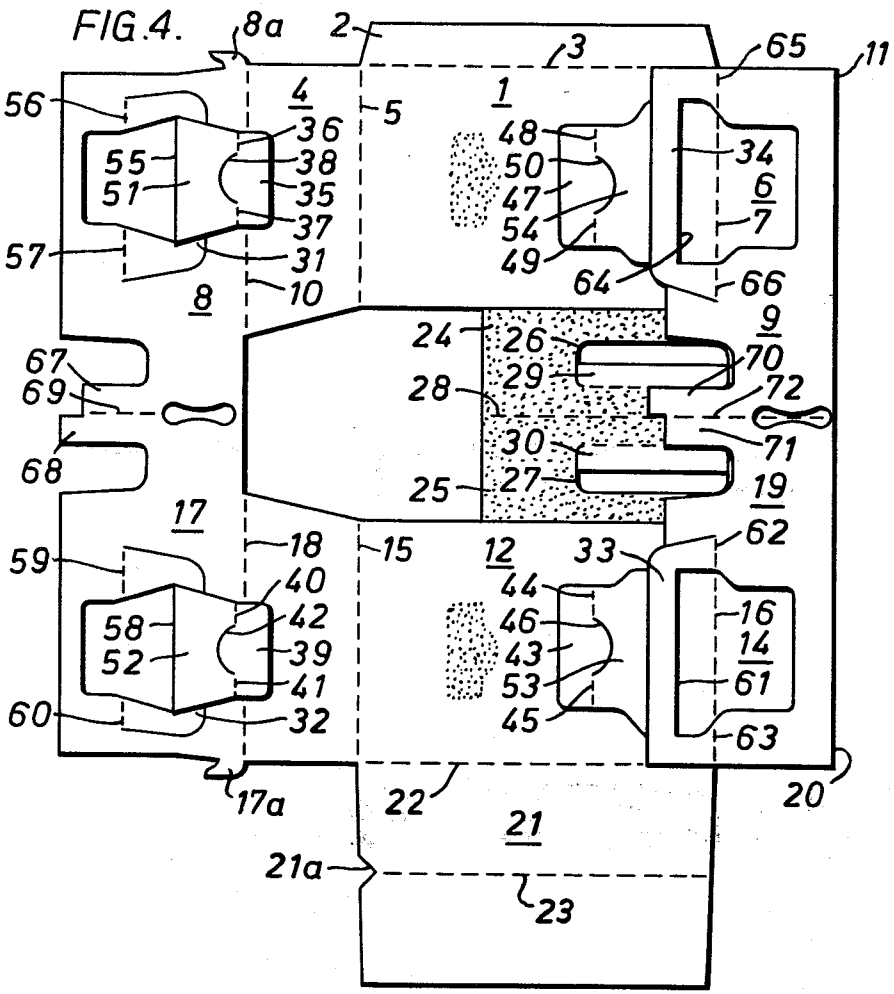

In a similar manner the third folding operation causes the side wall panels 4 and 13 together with their associated medial panels 8 and 17 to be hinged upwardly out of the plane of the blank about fold lines 5 and 15 and rotated 180° towards the right as viewed in FIG. 4 so that the anchoring tabs 35 and 39 are brought into contact with and adhered to the other set of glued areas of side wall panels 1 and 12 respectively. The areas of the medial panels 8 and 17 which come into contact with the glued inner surfaces of the handle panels 24 and 25 e.g. the fingers 67 and 68 of the projecting tab are adhered to the handle panels 24 and 25. The blank is now in the configuration shown in FIG. 5 of the drawings.

Figure 5:
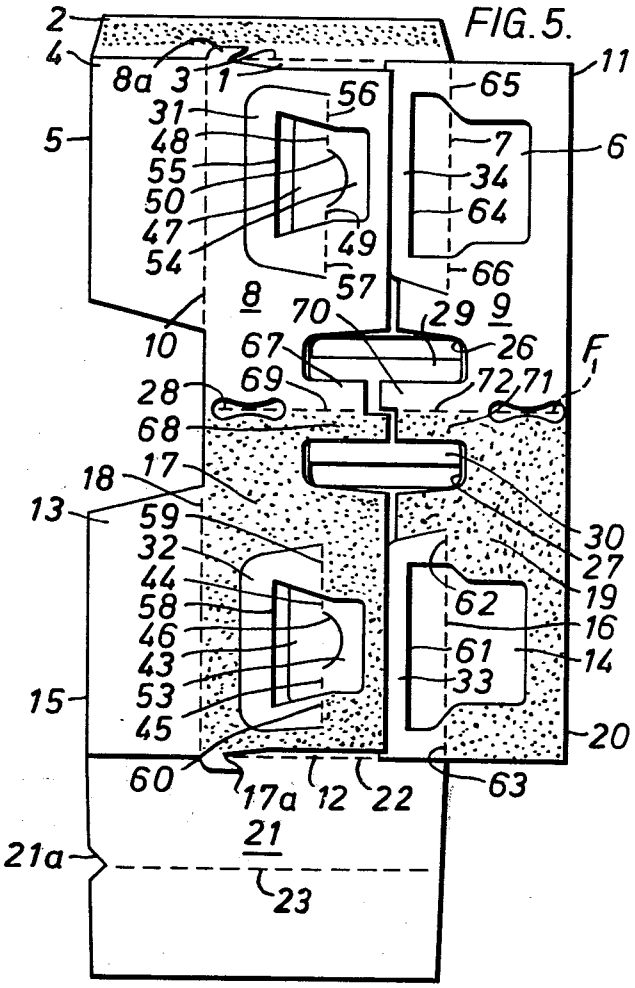

A further application of glue is then made to the areas shown in stippling in FIG. 5 of the drawings. Following this the bottom wall 21 is hinged about the fold line 23 so that the bottom wall is folded over on itself and generally simultaneously the portion of the article carrier blank which is disposed above the central fold line 'F' as viewed in FIG. 5 is elevated and folded over 180° into the position shown in FIG. 6 of the drawings whereby the glue flap 2 is adhered to the longitudinal free edge of bottom wall panel 21. The carrier then appears as shown in FIG. 6 which represents the completed carrier in collapsed position.

Figure 6:
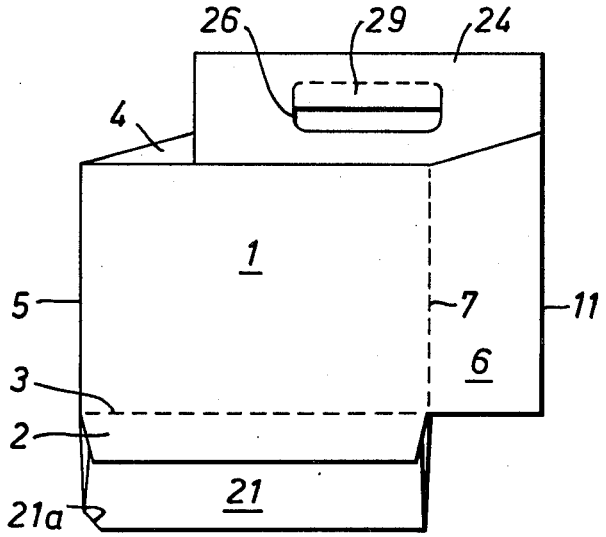

In order to set up the carrier from its collapsed condition as shown in FIG. 6 into the condition as shown in FIG. 1 it is simply necessary to secure the side walls 1 and 12 against movement towards the left and to apply a force towards the left the medial edges of end wall panels 6 and 14. This expands the carrier and moves the side walls apart. Simultaneously, the bottom wall 21 folds into a flat plane and the carrier is maintained in set up condition by co-operation between the locking tab formed by the joined projections 8*a* and 17*a* and the notch 21*a* formed in the bottom wall 21. The carrier then appears as shown in FIG. 1.

It will be appreciated that this invention produces an article carrier which has a double thickness medial and transverse partitions at all areas in which article contact will arise. Thus maximum protection is afforded, in particular for fragile articles such as glass bottles.

The embodiments of the invention in which an exclusive property or privilege is claimed are defined as follows:

1. A blank for a cellular article carrier comprising a pair of side wall forming panels, end wall panels hinged to opposed end edges of said side wall forming panels, medial panels foldably joined to each of said end wall panels along the edges thereof remote from said side walls, each of said medial panels having struck therefrom a transverse partition forming structure comprising a main transverse partition panel hinged to that medial panel, a supplementary transverse partition panel hinged to said main transverse partition panel and arranged to be folded into overlapping relationship with at least a portion of said main transverse partition panel, and an anchoring tab hinged to said supplementary transverse partition panel, characterized in that said supplementary transverse partition panels and anchoring tabs associated with each of said medial panels are all arranged so as to extend in the same direction toward one and the same end of said blank before being folded and that all of said supplementary transverse partition panels are hinged to said main transverse partition panels so as to be rotated and folded in one and the same direction when the carton is formed.

2. The blank according to claim 1 in which each of said supplementary transverse partition panel is struck partly from its associated main transverse partition panel and partly from its associated medial panel and in which each anchoring tab is struck from said medial panel.

3. The blank according to claim 1 in which a pair of handle panels are disposed between said side wall forming panels and hinged to said medial partition structures at one end of the blank.

4. The blank according to claim 1 in which the transverse partition structures associated with the medial panels at one end of the blank are struck entirely from within the boundaries of said medial panels.

* * * * *